US006298926B1

(12) United States Patent
Dalkert et al.

(10) Patent No.: US 6,298,926 B1
(45) Date of Patent: Oct. 9, 2001

(54) BLAST HOLE DRILL WITH IMPROVED DECK WRENCH

(75) Inventors: Marcia H. Dalkert, Brookfield; Jack W. Nelson, Milwaukee; David A. Kaphingst, Sussex, all of WI (US); Curt L. Silvestri, Mesa, AZ (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 0 days.

(21) Appl. No.: 09/501,829

(22) Filed: Feb. 10, 2000

(51) Int. Cl.[7] ..... E21B 3/00; E21B 19/00
(52) U.S. Cl. ..... 175/52; 175/85
(58) Field of Search ..... 175/52, 85, 161, 175/162, 203, 220; 173/164; 81/57.33; 414/741, 745.2

(56) References Cited

U.S. PATENT DOCUMENTS

| | | | | |
|---|---|---|---|---|
| 4,455,116 | * | 6/1984 | Lindstedt et al. | 414/22 |
| 4,637,475 | * | 1/1987 | England et al. | 173/43 |
| 5,518,076 | * | 5/1996 | Holz et al. | 175/57 |
| 5,622,232 | * | 4/1997 | Whisenhunt | 175/85 |
| 5,653,297 | * | 8/1997 | Whisenhunt | 175/52 |

* cited by examiner

*Primary Examiner*—Robert E. Pezzuto

(74) *Attorney, Agent, or Firm*—David R. Price; James Earl Lowe, Jr.

(57) ABSTRACT

A blasthole drill including a deck wrench for holding a drill pipe section to facilitate the unthreading of an adjoining drill pipe section from an overall drill pipe string. The deck wrench includes an engagement surface which is selectively engageable with an engagement surface of a drill pipe section to substantially prevent rotation of the drill pipe section in either direction about its longitudinal axis. The deck wrench is engageable with an upper drill pipe section so that a joint between the upper drill pipe section and a rotary head can be tightened when the rotary head is rotated in one direction. The deck wrench is engageable with a lower drill pipe section so that a joint between the lower drill pipe section and the upper drill pipe section can be broken when the rotary head is rotated in an opposite direction. The joint between the rotary head and the upper drill pipe section, once tightened, should be stronger than the joint between the upper drill pipe section and the lower drill pipe section. As a result, when the rotary head is rotated in order to break the joint between the upper drill pipe section and the lower drill pipe section, the joint between the rotary head and the upper drill pipe section will not break. The engagement between the deck wrench and the drill pipe is such that the drill pipe has a limited range of pivotal movement in either direction about its longitudinal axis to allow a certain amount of momentum to be transferred to the drill pipe by the rotation of the rotary head to enhance the tightening or loosening effect of the relevant joint.

14 Claims, 4 Drawing Sheets

38
82
86
98
110
108
42
40

38
82
86
118
114
102
98
110
106
142
154
58
66
50
40
60
54
90
42
182
168
162
178
186
138
146
144
140
108
158

30
86
106
146
108
46
102
42
54

42
182
162
168
166
178
186
186
46
170
174
108
118
86
109
110
134
30
130
114
V
V

BLAST HOLE DRILL WITH IMPROVED DECK WRENCH

FIELD OF THE INVENTION

The present invention relates generally to blasthole drills, and more particularly to a deck wrench for holding a drill pipe section against rotation.

BACKGROUND OF THE INVENTION

Blasthole drills are large earth drilling machines typically used in mining operations to drill holes for explosives. A conventional blasthole drill comprises a frame supported by crawlers for movement over the ground, and a mast supported by the frame for movement between a substantially vertical position and a number of angled or non-vertical positions. A rotary head moves along the mast. The rotary head engages the upper end of a drill pipe for rotating the drill pipe and driving the drill pipe into the ground. When drilling a blasthole that is deeper than the height of the mast, more than one section of drill pipe must be used. After the first section of drill pipe is driven into the ground, the rotary head moves back to the top of the mast and another section of drill pipe is connected to the top of the first section. The rotary head then drives the second drill pipe section into the ground. It is not unusual to use multiple sections of drill pipe. Such a deep blasthole is commonly referred to as a "multi-pass" blasthole. The various sections of drill pipe are usually supported relative to the mast and moved into position at the appropriate time by a device known as a pipe rack. One such pipe rack is disclosed in U.S. Pat. No. 5,622,232, which is incorporated herein by reference.

When drilling a multi-pass blasthole, a considerable amount of time is spent in adding and removing individual drill pipe sections from the overall drill pipe string. In the art of earth drilling machines, the process of separating drill pipe sections has long been one in which improvements have been sought. The problem of disconnecting or unthreading tightly connected joints between drill pipe sections has resulted in numerous devices for clamping and holding one drill pipe section while rotating the other drill pipe section.

Typically, an attempt is made to break the joint between two drill pipe sections by rotating the upper drill pipe section with the rotary head while the lower drill pipe section is held by the drill pipe holding wrenches. More often than not, the joint between the drill pipe sections is stronger or tighter than the joint between the rotary head and the upper drill pipe section. As a result, when using the rotary head to try and loosen the joint between two drill pipe sections, the joint between the rotary head and the upper drill pipe section usually breaks instead. Thus, if the joint between the drill pipe sections cannot be broken loose with the rotary head, a breakout wrench is commonly used to rotate the upper drill pipe section while a deck wrench holds the lower drill pipe section against rotation. An automatic breakout wrench is disclosed in U.S. Pat. No. 5,653,297, which is incorporated herein by reference. The automatic breakout wrench turns the upper drill pipe section while the lower drill pipe section is held by the deck wrench. This type of change-out procedure usually adds undesirable downtime to an overall blasthole drilling operation.

Conventional deck wrenches generally include a pair of opposed drill pipe holding members which are disposed on a drill deck and which are aligned with each other on opposite sides of an opening in the drill deck through which the drill pipe extends. Each drill pipe holding member is slideably mounted in a respective housing. Each section of the drill pipe generally includes a pair of recesses on opposite sides thereof. When it is desirable to unthread an upper drill pipe section from a lower drill pipe section, each drill pipe holding member engages a respective recess in the lower drill pipe section. The mating action of the members and recesses holds the lower drill pipe section against rotation in a single direction so that the upper drill pipe section can be unthreaded or disconnected from the lower drill pipe section.

SUMMARY OF THE MENTION

Although the conventional method of using a breakout wrench in cooperation with a deck wrench to facilitate the separation of two drill pipe sections is effective for such a purpose, there is still a need in the art for new equipment and methods for more easily and efficiently separating drill pipe sections. The invention provides an improved deck wrench. Unlike conventional deck wrenches, the deck wrench according to the invention is able to substantially prevent rotation of a drill pipe in either direction. As a result, the deck wrench is able to hold a drill pipe section so that a joint between the drill pipe section and another drill pipe section can be tightened or loosened as desired.

The invention provides a blasthole drill comprising a frame supported for movement over a ground surface, the frame including a drill deck having an opening, a mast supported by the frame, a drill pipe which is supported relative to the mast and which extends through the opening, the drill pipe having a longitudinal axis and further having an engagement surface, a rotary head movable along the mast for rotating and longitudinally moving the drill pipe, and a deck wrench mounted on the drill deck, the deck wrench having an engagement surface which is selectively engageable with the drill pipe engagement surface to substantially prevent rotation of the drill pipe in either direction about the longitudinal axis.

The invention also provides a blasthole drill comprising a frame supported for movement over a ground surface, the frame including a drill deck having an opening, a mast supported by the frame, a drill pipe which is supported relative to the mast and which extends through the opening, the drill pipe having a longitudinal axis, a rotary head movable along the mast for rotating and longitudinally moving the drill pipe, and a deck wrench mounted on the drill deck, the deck wrench including a movable member having opposite facing engagement surfaces each of which is engageable with an opposite side of the drill pipe to hold the drill pipe against substantial rotation.

To unthread an upper drill pipe section from a lower drill pipe section, the deck wrench first engages the lower drill pipe section. The rotary head then rotates the upper drill pipe section in one direction to tighten the joint between the rotary head and the upper drill pipe section. Thereafter, the deck wrench is disengaged from the lower drill pipe section so that the next or lower drill pipe section can be raised out of the blasthole. The deck wrench then engages the lower drill pipe section. The rotary head then rotates the drill pipe in the opposite direction to break the joint between the drill pipe sections. Because the deck wrench can substantially prevent rotation of the drill pipe in either direction, the joint at the rotary head and the upper drill pipe section can be made stronger or tighter than the joint between the upper and lower drill pipe sections before an attempt is made to break the joint between the two drill pipe sections. According to the present invention, it is no longer necessary to use a breakout wrench when disconnecting two drill pipe sections, thereby decreasing the downtime normally associated with a drill pipe change-out procedure in a blasthole drilling operation.

Although the engagement between the deck wrench and the drill pipe substantially prevents rotation of the drill pipe about its longitudinal axis, the engagement between the deck wrench and the drill pipe also allows the drill pipe to have a limited range of pivotal movement in either direction about its longitudinal axis when the drill pipe is positioned within the U-shaped recess. This limited range of pivotal movement allows the rotary head to provide some momentum to the drill pipe to enhance the tightening or loosening effect of the particular joint.

Other features and advantages of the invention will become apparent to those skilled in the art upon review of the following detailed description, claims and drawings in which like numerals are used to designate like features.

Figure 1:
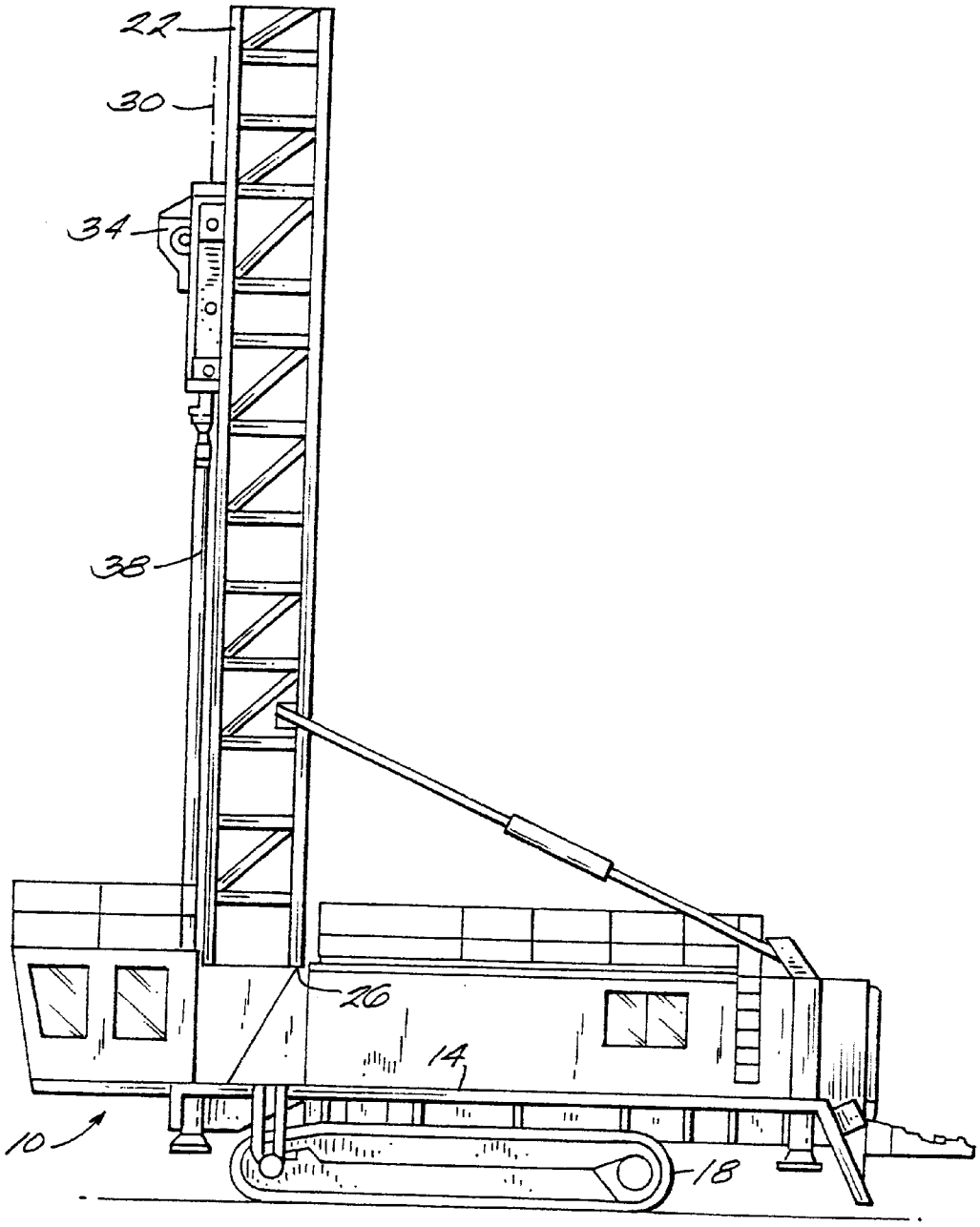
FIG. 1 is a side elevational view of a blasthole drill embodying the invention and including a deck wrench.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

DETAILED DESCRIPTION OF THE PREFERRED EMBODIMENT

Illustrated in FIG. 1 is a blasthole drill 10 embodying the invention. The blasthole drill 10 comprises a frame 14 supported by crawlers 18 for movement over the ground. A mast 22 is supported by the frame 14 for movement relative thereto about a generally horizontal axis 26 between a substantially vertical position (as shown) and a number of angled or non-vertical positions (not shown). The mast 22 defines a drill hole axis 30. A rotary head 34 is movable relative to the mast 22 along the drill hole axis 30. The rotary head 34 is selectively engageable with an upper end of a drill pipe 38 supported relative to the mast 22. The drill pipe 38 includes a longitudinal axis which coincides with the drill hole axis 30. The drill pipe 38 can comprise a single drill pipe section or multiple drill pipe sections. The blasthole drill 10 thus far described is conventional and will not be described in greater detail.

Figure 2:
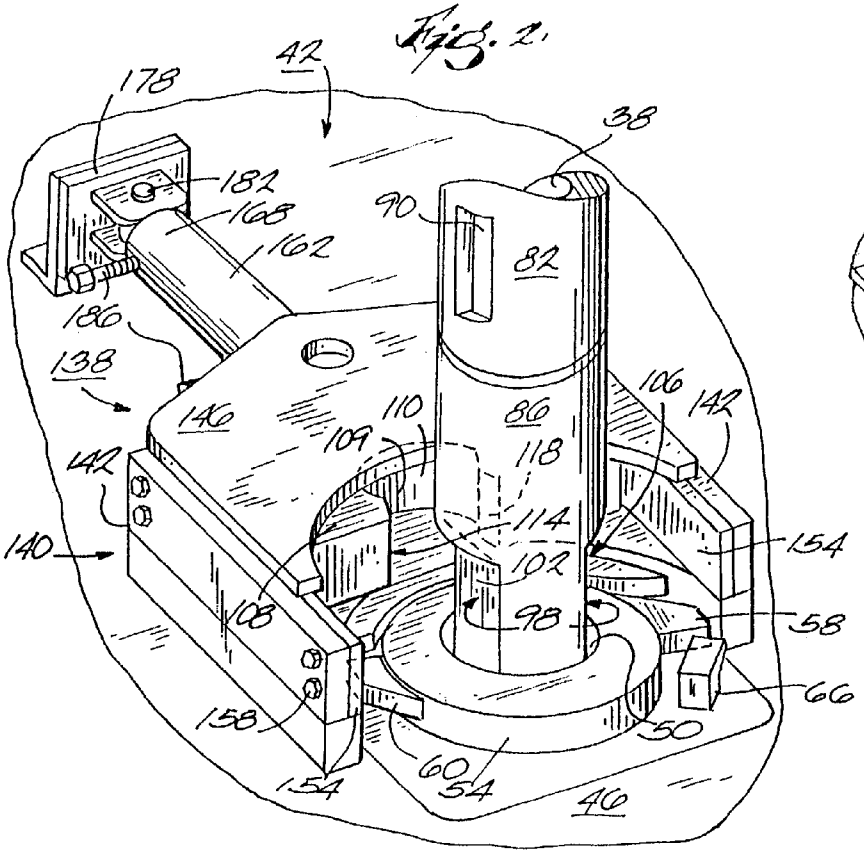
FIG. 2 is an enlarged, perspective view of the deck wrench disengaged from a drill pipe.
Figures 4, 5:
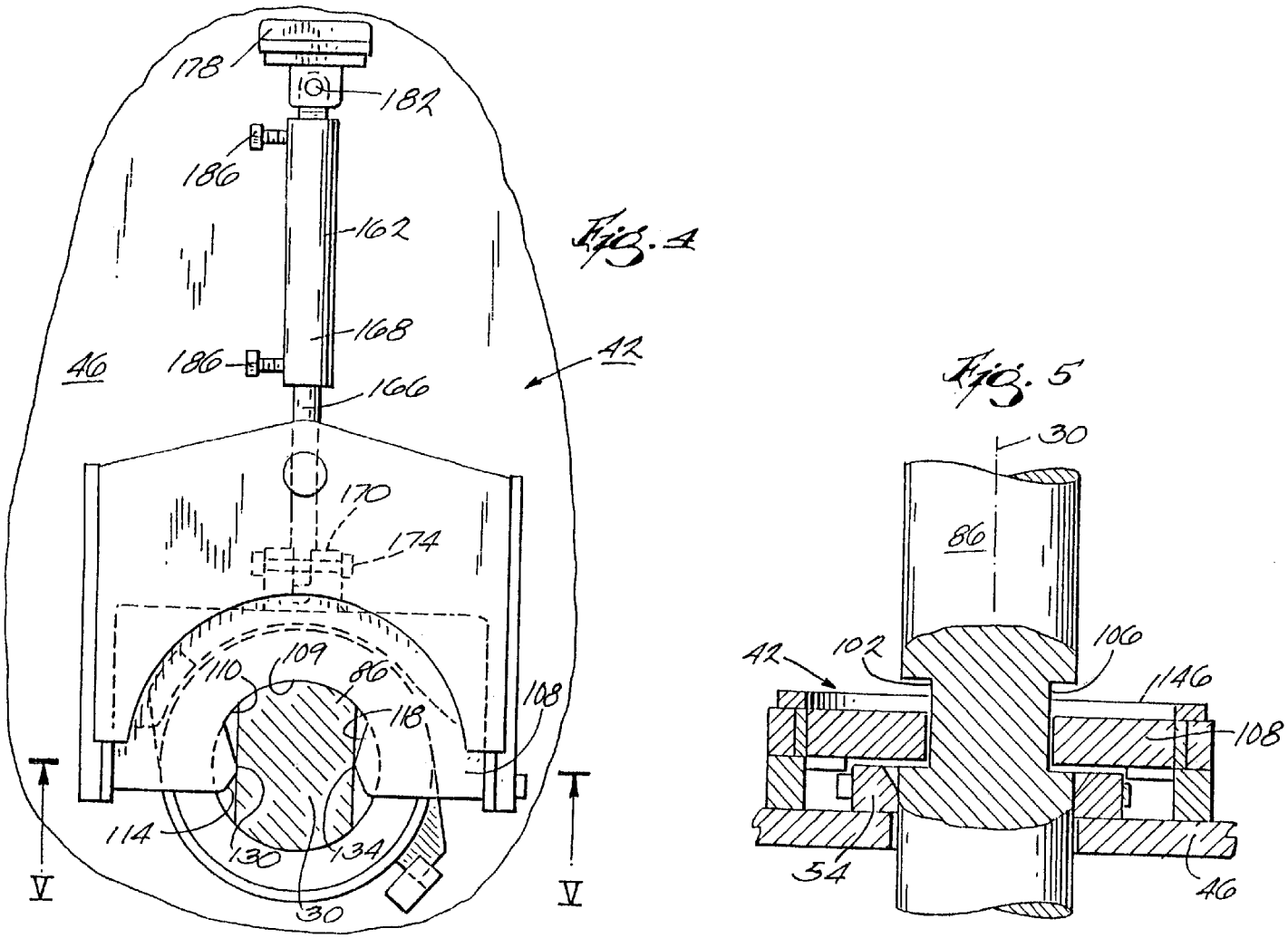
FIG. 4 is a top plan view of the deck wrench and drill pipe shown in FIG. 3.
FIG. 5 is a cross-sectional view taken along line V—V of FIG. 4.

Referring to FIG. 2, the blasthole drill 10 comprises a deck wrench 42 mounted on a drill deck 46. The deck wrench is further described below. The frame 14 (FIG. 1) supports the drill deck 46 as is known. The drill deck 46 includes an opening 50 through which the drill pipe 38 extends. A bit basket 54 which receives the drill pipe 38 extends over the drill deck opening 50. The bit basket 54 includes diametrically opposed, outwardly extending wings 58 and 60. A locking member 66 is mounted on the drill deck 46 such as, for example, by welding. When the bit basket wing 58 engages the locking member 66, the bit basket 54 is substantially locked in place (FIG. 4), against both upward movement and clockwise movement as shown in FIG. 4, for reasons generally known to those skilled in the art.

With continued reference to FIG. 2, a portion of an upper drill pipe section 82 and a portion of a lower drill pipe section 86 are shown. The drill pipe sections 82 and 86 can be threaded together as commonly understood. The lower end of the upper drill pipe section 82 includes a pair of recesses 90 (only one shown), one on each side thereof, as is known in the art. It should be noted that the lower end of each drill pipe section, such as lower drill pipe section 86, usually includes a pair of recesses like recesses 90. The upper end of the lower drill pipe section 86 includes an engagement surface 98 for engagement with the deck wrench 42. The drill pipe engagement surface 98 includes two portions 102 and 106, one on each side of the drill pipe section 86, formed by recesses or indentations in the drill pipe section 86 (see also FIG. 5). The drill pipe engagement surface portions 102 and 106 are substantially flat, and substantially parallel to each other and to the longitudinal axis 30. It should be noted that the upper end of each drill pipe section, such as upper drill pipe section 82, includes an engagement surface like engagement surface 98.

Referring still to FIG. 2, the deck wrench 42 includes a movable member 108 having a substantially U-shaped recess 109 defining an engagement surface 110. Preferably, the movable member 108 is made of a high strength steel alloy. The movable member 108 is supported by a frame 112 for horizontal reciprocal movement (up and down in FIG. 4). The frame 112 is described below in greater detail. The engagement surface 110 of the movable member 108 has two opposite facing portions 114 and 118. The engagement surface portions 114 and 118 have respective arcuate crowns 130 and 134 (FIG. 4).

Figure 3:
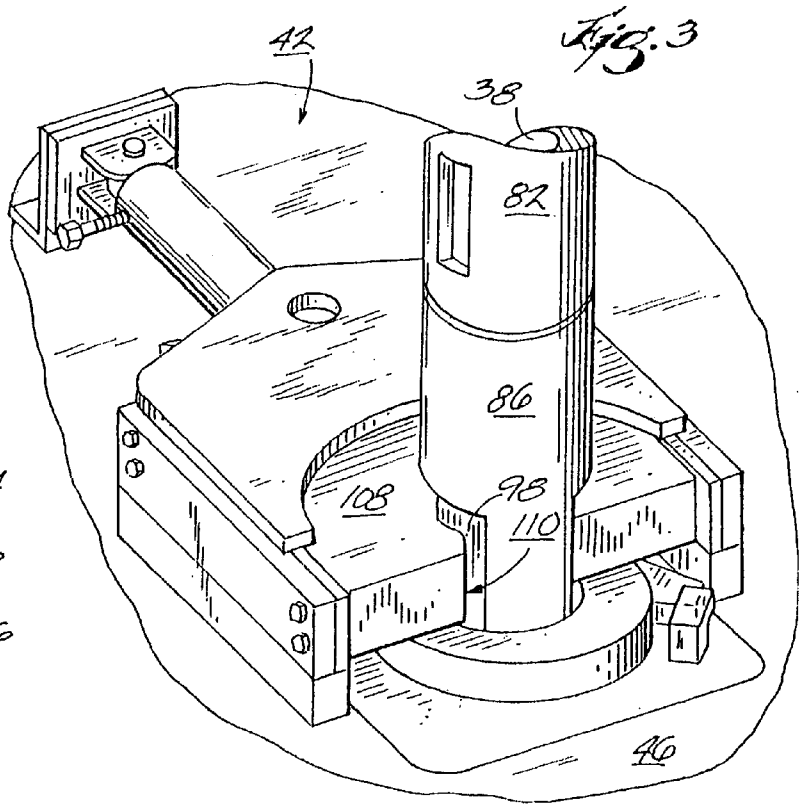
FIG. 3 is a view similar to FIG. 2 showing the deck wrench engaged with the drill pipe.

FIG. 2 shows the movable member 108 in a retracted position such that the deck wrench 42 is not engaging the drill pipe section 86. When the movable member 108 is in this position, the drill pipe section 86 is not within the U-shaped recess 109 of the movable member 108. FIGS. 3–5 illustrate the member 108 in an extended position such that the deck wrench 42 is engaging the drill pipe section 86. When the movable member 108 is in this position, the drill pipe section 86 is within the U-shaped recess 109 of the movable member 108. When the deck wrench 42 engages the drill pipe section 86, the deck wrench engagement surface 110 engages the drill pipe engagement surface 98. More particularly, the deck wrench engagement surface portion 114 engages the drill pipe engagement surface portion 102, and the deck wrench engagement surface portion 118 engages the drill pipe engagement surface portion 106. The deck wrench 42 thereby substantially prevents rotation of the drill pipe section 86 about its longitudinal axis. However, as best shown in FIG. 4, the arcuate crowns 130 and 134 of the deck wrench engagement surface portions 114 and 118 allow the drill pipe section 86 to have a limited range of pivotal movement, preferably fifteen degrees in either direction, about its longitudinal axis 30. The limited range of pivotal movement allows the pipe section 86 to gain some rotational momentum before engagement of the wrench 42 stops rotation, thus increasing the ability to tighten or break the joint between the pipe sections 82 and 86.

Referring to FIGS. 2 and 4, the frame 112 includes a frame member 138 fixed to the drill deck 46 such as, for example, by welding. The frame member 138 is generally U-shaped and includes a base 140 having spaced apart, opposite sides 142. The frame member 138 also includes a top plate 146 which extends between the sides 142 of the base 140. The wing 60 of the bit basket 54 moves under a portion of the base 140 when the bit basket rotates clockwise as shown in FIG. 4, so that the base 140 helps prevent upward movement of the bit basket 54. Each side 142 of the base 140 includes a wear plate 154 which is attached to the frame member 138 with screws 158. The frame member 138 and wear plates 154 can be made of any suitable material or of any suitable construction consistent with the principles of the invention. The frame member 138 houses the movable member 108 for reciprocal movement as described above. The sides of the movable member 108 are generally in sliding contact with the wear plates 154. The wear plates 154 are designed to reduce friction between the frame member 138 and the movable member 108. Once worn, the wear plates 154 can simply be removed and replaced. Other lubrication means can be applied to the movable member 108 and frame member 138 if desired. A hydraulic actuator 162 mounted on the deck moves the member 108 relative to the frame member 138 and into an out of engagement with the drill pipe 38. The actuator 162 includes a piston rod 166 extending from a cylinder 168. The outer end of the rod 166 is connected to a boss 170 of the movable member 108 with a suitable fastener such as a cotter pin or a bolt and nut combination 174. The blind end of the cylinder 168 is pivotally connected with a cotter pin 182 or the like to a mounting structure 178 fixed to the drill deck 46. The actuator 162 is controlled by proximity switches 186 that signal the control system (not shown) when the piston (not shown) nears the ends of the cylinder 168.

Figure 6:
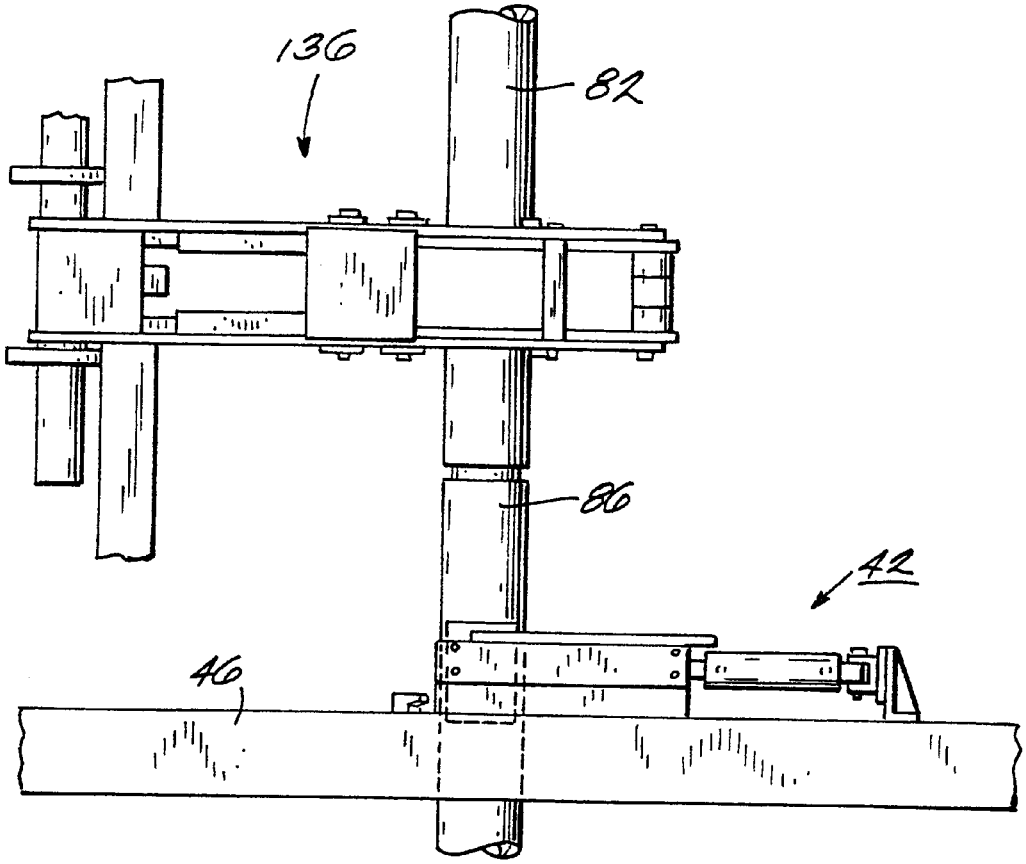
FIG. 6 is a side elevational view of the deck wrench and a breakout wrench of the blasthole drill.

The blasthole drill 10 also comprises (see FIG. 6) a breakout wrench 136. Any suitable breakout wrench can be used, such as the one disclosed in U.S. Pat. No. 5,653,297. Although not clearly shown, it is envisioned that the breakout wrench 136, with cooperation of the recesses 90, could be used to break the joint between the rotary head 34 (FIG. 1) and the upper drill pipe section 82 after the upper drill pipe section 82 has been lifted out of the blasthole.

The deck wrench 42 is used as follows. With a drill pipe section (e.g., the section 86) in position on the mast, the rotary head is rotated to thread into the upper end of the section 86 and then to rotate the section 86 and drill into the ground. If desired, the wrench 42 can be used to hold the section 86 against rotation while threading the rotary head into the pipe section 86. When the section 86 is in the position shown in FIG. 2, the wrench 42 engages the section 86 as shown in FIG. 3, and the rotary head is rotated in the opposite direction to unthread the rotary head from the section 86. The section 82 is then moved into position above the section 86, and the rotary head is rotated to thread into the upper end of the section 82, to thread the section 82 into the section 86, and to rotate the sections 82 and 86 and further drill into the ground. This process can be repeated for any number of drill sections.

To remove a pipe section (e.g. the section 82) from the drill string, the rotary head is raised until the section is in the position shown in FIGS. 2 and 3, and the wrench 42 then engages the section 86 as shown in FIG. 3. The rotary head is then rotated in the unthreading direction so as to break the joint between the drill pipe sections 82 and 86 without breaking the joint between the rotary head and the drill pipe section 82. In the event rotation of the rotary head breaks the joint between the rotary head and the drill pipe section 82 instead of the joint between the sections 82 and 86, the breakout wrench is used to break the joint between the sections 82 and 86, with the wrench 42 still engaging the section 86. This process is then repeated to remove the other sections from the drill string.

Variations and modifications of the foregoing are within the scope of the present invention. For example, the deck wrench engagement surface may simply engage opposite sides of a drill pipe to accomplish the advantages and features according to the principles of the invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A blasthole drill comprising:

a frame supported for movement over a ground surface, said frame including a drill deck having an opening;

a mast supported by said frame;

a drill pipe which is supported relative to said mast and which extends through said opening, said drill pipe having a longitudinal axis and further having an engagement surface; wherein said drill pipe engagement surface has two portions, one on each side of said drill pipe, wherein said drill pipe engagement surface portions are substantially flat, and substantially parallel to each other and to said longitudinal axis, a rotary head movable along said mast for rotating and longitudinally moving said drill pipe; and a deck wrench mounted on said drill deck, said deck wrench having an engagement surface which is selectively engageable with said drill pipe engagement surface to substantially prevent rotation of said drill pipe in either direction about said longitudinal axis, wherein said deck wrench engagement surface has two opposite facing portions.

2. A blasthole drill according to claim 1, wherein said deck wrench includes a movable member which is reciprocally movable and which has thereon said engagement surface.

3. A blasthole drill according to claim 2, further comprising:

a frame member fixed to said drill deck; and a hydraulic actuator for moving said movable member relative to said frame member.

4. A blasthole drill according to claim 1, wherein said deck wrench includes a movable member having a substantially U-shaped recess defined at least in part by said opposite facing portions, such that when said deck wrench engagement surface engages said drill pipe engagement surface, said drill pipe is positioned within said U-shaped recess, and such that when said deck wrench engagement surface is not in engagement with said drill pipe engagement surface, said drill pipe is not positioned within said U-shaped recess.

5. A blasthole drill according to claim 4, wherein said deck wrench engagement surface portions enable said drill pipe to have a limited range of pivotal movement in either direction about said longitudinal axis when said drill pipe is positioned within said U-shaped recess.

6. A blasthole drill according to claim 5, wherein said limited range of pivotal movement is approximately 15 degrees in either direction.

7. A blasthole drill according to claim 6, wherein each deck wrench engagement surface portion has an arcuate crown.

8. A blasthole drill comprising:

a frame supported for movement over a ground surface, said frame including a drill deck having an opening;

a mast supported by said frame;

a drill pipe which is supported relative to said mast and which extends through said opening, said drill pipe having a longitudinal axis; wherein each side of said drill pipe includes a portion each of which is substantially flat, and each of which is substantially parallel to the other and to said longitudinal axis, such that when said movable member engages said drill pipe, a rotary head movable along said mast for rotating and longitudinally moving said drill pipe; and a deck wrench mounted on said drill deck, said deck wrench including a movable member having opposite facing engagement surfaces each of which is engageable with an opposite side of said drill pipe to hold said drill pipe against substantially rotation, wherein said movable member has a substantially U-shaped recess defined at least in part by said opposite facing engagement surfaces, such that when said movable member engages said drill pipe, said drill pipe is positioned within said U-shaped recess, and each movable member engagement surface engages a respective drill pipe side portion, and such that when said movable member is not in engagement with said drill pipe, said drill pipe is not positioned within said U-shaped recess.

9. A blasthole drill according to claim 8, wherein said movable member engagement surfaces enable said drill pipe to have a limited range of pivotal movement in either direction about said longitudinal axis when said drill pipe is positioned within said U-shaped recess.

10. A blasthole drill according to claim 9, wherein said limited range of pivotal movement is approximately 15 degrees in either direction.

11. A blasthole drill according to claim 10, wherein each movable member engagement surface has an arcuate crown.

12. A blasthole drill according to claim 8, wherein said movable member is reciprocally moveable.

13. A blasthole drill according to claim 12, further comprising:

a frame member fixed to said drill deck; and a hydraulic actuator for moving said movable member relative to said frame member.

14. A blasthole drill comprising:

a frame supported for movement over a ground surface, said frame including a drill deck having an opening;

a mast supported by said frame;

a drill pipe which is supported relative to said mast and which extends through said drill deck opening, said drill pipe having a longitudinal axis and further having an engagement surface which includes two portions, one on each side of said drill pipe, such that said portions are substantially flat, and substantially parallel to each other and to said longitudinal axis;

a rotary head movable along said mast for rotating and longitudinally moving said drill pipe;

a frame member fixed to said drill deck;

a deck wrench which includes a movable member having an engagement surface which includes a pair of opposite facing portions each having an arcuate crown, wherein said movable member has a substantially U-shaped recess which is at least defined in part by said engagement surface portions; and a hydraulic actuator for reciprocally moving said movable member relative to said frame member for selective engagement with said drill pipe, such that when said movable member engages said drill pipe, said drill pipe is substantially positioned within said U-shaped recess and said movable member engagement surface portions engage respective drill pipe engagement surface portions to substantially prevent rotation of said drill pipe in either direction about said longitudinal axis and to also allow said drill pipe a limited range of pivotal movement in either direction about said longitudinal axis, and such that when said movable member is not in engagement with said drill pipe, said drill pipe is not positioned within said U-shaped recess.

* * * * *